US005823523A

United States Patent [19]

Park

[11] Patent Number: 5,823,523

[45] Date of Patent: Oct. 20, 1998

[54] AUTO SHEET FEEDER FOR USE IN A PRINTING APPARATUS

[75] Inventor: Jin-ho Park, Kyungki-do, Rep. of Korea

[73] Assignee: Samsung Electronics Co., Ltd., Rep. of Korea

[21] Appl. No.: 756,308

[22] Filed: Nov. 25, 1996

[30] Foreign Application Priority Data

Nov. 24, 1995 [KR] Rep. of Korea ..... 95-35419

[51] Int. Cl.[6] ..... B65H 5/00

[52] U.S. Cl. ..... 271/10.04; 271/10.13; 271/116

[58] Field of Search ..... 271/4.04, 4.1, 271/10.11, 10.13, 10.04, 10.05, 114, 116

[56] References Cited

U.S. PATENT DOCUMENTS

| | | | |
|---|---|---|---|
| 4,909,498 | 3/1990 | Rutishauser | 271/10.04 |
| 4,986,525 | 1/1991 | Takagi et al. | 271/4.04 |
| 5,051,014 | 9/1991 | Takagi et al. | 271/116 |
| 5,160,128 | 11/1992 | Oishi | 271/116 |
| 5,213,426 | 5/1993 | Ewing | 271/114 |

FOREIGN PATENT DOCUMENTS

| | | | |
|---|---|---|---|
| 405092838 | 4/1993 | Japan | 271/4.04 |
| 405092839 | 4/1993 | Japan | 271/4.04 |

*Primary Examiner*—H. Grant Skaggs
*Attorney, Agent, or Firm*—Banner & Witcoff, Ltd.

[57] ABSTRACT

Auto sheet feeding device for feeding a sheet into a printing apparatus at each time of printing operation is disclosed. A pinch gear engaged with a motor gear is arranged to be in mesh with a pair of idle gears at both sides, respectively. One of the idle gears is engaged with a gear for driving a delivery roller while the other is in mesh with feeding roller through a train of gearing.

A latch gear and feeding roller driving gear are formed integrally and are coaxial mounted on same pivot with another idle gear. A groove is formed between the latch gear and feeding roller driving gear so that an elastic ring having a pair of edge portions can be received and secured. The edge portions of an elastic ring are arranged to selectively contact with boss formed on a wing tab. According to the rotational direction of gears in the train of gearing, power transmission from the motor to feeding roller is intermitted by an operation of the latch thereby controlling sheet feeding in a printing operation.

8 Claims, 3 Drawing Sheets

AUTO SHEET FEEDER FOR USE IN A PRINTING APPARATUS

CLAIM OF PRIORITY

This application makes reference to, incorporates the same herein, and claims all benefits accruing under 35 U.S.C. Ø119 form an Utility Model application for Auto Sheet Feeding Apparatus For A Printer earlier filed in the Korean Industrial Property Office on 24 Nov. 1995 and there duly assigned Serial No. 35419/1995 by that Office.

FIELD OF THE INVENTION

The present invention relates in general to an auto sheet feeding device, and more particularly, to an improved auto sheet feeder for feeding a sheet at each time for printing operation from a paper tray mounted on a printing such as a printer, a plain paper facsimile machine and etc.

BACKGROUND OF THE INVENTION

As is well known in the art of printing machine, and particularly as shown in FIG. 1 a systematic configuration of a sheet feeder includes a feeding roller installed at substantially front end portion of a paper and is elastically biased toward a feeding roller so as to push a bunch of papers in the direction of spring take-up. A guide 40 is disposed to locate substantially adjacent to the front end portion of paper tray 10 so as to guide a sheet during printing operation. Both delivery roller 15 and a pinch roller 17 are installed on the path for delivering a sheet which is guided by a guide 40. In a sheet feeding roller in contact with the upper sheet of papers mounted in paper tray 10 is driven, then the upper sheet is forced to move towards delivery roller 15 by friction force caused by feeding roller. Then the sheet above explained is delivered by delivery roller 15 to a proper position for printing.

Such a printing apparatus as described above is to deliver sheets at a predetermined velocity and quantity, as required, in dependence upon the driving operation of a carriage in printing.

As a result, the above described printing apparatus is no longer able to deliver a sheet by simultaneously driving both feeding roller and delivery roller 15. Consequently, both rollers above mentioned are required to rotate in reverse direction about each other, or forced to sheet feeding device in a printing apparatus as such above, a conventionally adopted mechanism as shown in FIG. 2 has been widely used.

In the mechanism, a pinch gear 72 is engaged with first gear 71 linked to the pivot of motor 70. Second gear 73 for driving delivery roller is arranged to mesh with pinch gear 72 at a side thereof. An idle gear 75*a* is engaged to another side of pinch gear 72. A plurality of idle gears are arranged to form a line such that power transmission from motor 70 to cam 76 is achieved. Idle gear 75*e* among those idle gear for power transmission is linked with cam 76 to thereby move plate 30. Another idle gear 75*c* is arranged to mesh with third gear 74 for driving feeding roller 90 which is operated by an unidirectional clutch.

In operation, first gear 71 and pinch gear 72 in mesh therewith are driven to rotate in opposite directions when motor 70 initiates to rotate in clockwise direction. Cam 76 linked to an idle gear 75*e* among a plurality of idle gears that are sequentially engaged with pinch gear 72, is driven to push up plate 30, at the same time, third gear 74 linked to on unidirectional clutch is forced to deliver the upper sheet of papers 50 on to delivery roller 15 by rotating feeding roller 90 of substantially semilunar-shape one revolution.

Thereafter motor 70 is arranged to rotate in reverse direction so as to drive first gear 71 and pinch great 72, and in turn, to drive second gear 73 delivery roller 15 is driven by virtues of the rotational motion of second gear 73 such that a sheet may be placed in a proper location for printing, Such a conventional configuration as described above requires a number of components due to the need for employing a plurality of idle gears, causing a complicated assembly process, thereby degrading reliability of a product. Further, a sensor 95 is also required to determine a proper position of semilunar-shaped feeding roller 90 after its rotational motion for one revolution, which eventually complicates control circuits for printing operation.

Based upon my study of the contemporary apparatus such as these exemplars, I believe that there is a need for an improved auto sheet feeding apparatus as in the present invention.

SUMMARY OF THE INVENTION

Accordingly, it is an object of the present invention to provide an improved auto sheet feeding device for use in a printing apparatus.

It is another object of the present invention to provide an auto sheet feeding device in simplified configuration with reduced size.

It is still another object of the present invention to provide an auto sheet feeding device capable of reducing the time required for sheet feeding operation by simplifying driving mechanism.

To achieve these and other objects, there is provided an auto sheet feeding device for use in a printing apparatus. The device as described above is equipped with a motor for generating and transmitting power. A pair of idle gears are provided to mesh with pinch gears, at both sides thereof, which is engaged with a gear linked to the pivot of motor. One of the above idle gears is arranged to mesh with other idle gear is coaxial mounted on same axis with either latch gear and feeding roller driving gear. The above latch integrally formed and are arranged to form a groove in substantially circular shape to receive an elastic ring.

The other idle gear as explained above is provided with a pivot extended from the inner surface of substantially peripheral area in the vicinity of the tooth thereof.

The pivot as motioned above is provided with a latch at a portion adjacent to the inner surface of the idle gear. Also provided at the opposite portion of the pivot is a wing tab. The wing tab is formed perpendicular to the axial direction of the pivot.

A boss is integrally formed on the wing tab. The boss is arranged to selectively contact with one edge portion of the ring above described so as to release, or suspend, the above described latch according to rotational direction of the gears coaxial mounted on same pivot, thereby controlling the operation of feeding roller driving gear.

BRIEF DESCRIPTION OF THE DRAWINGS

A more complete appreciation of the invention, and many of the attendant advantages thereof better understood by reference to the following detailed description when considered in conjunction with the accompanying drawings in which like reference symbols indicated the same or similar components, wherein.

DETAILED DESCRIPTION OF THE INVENTION

Figure 1:
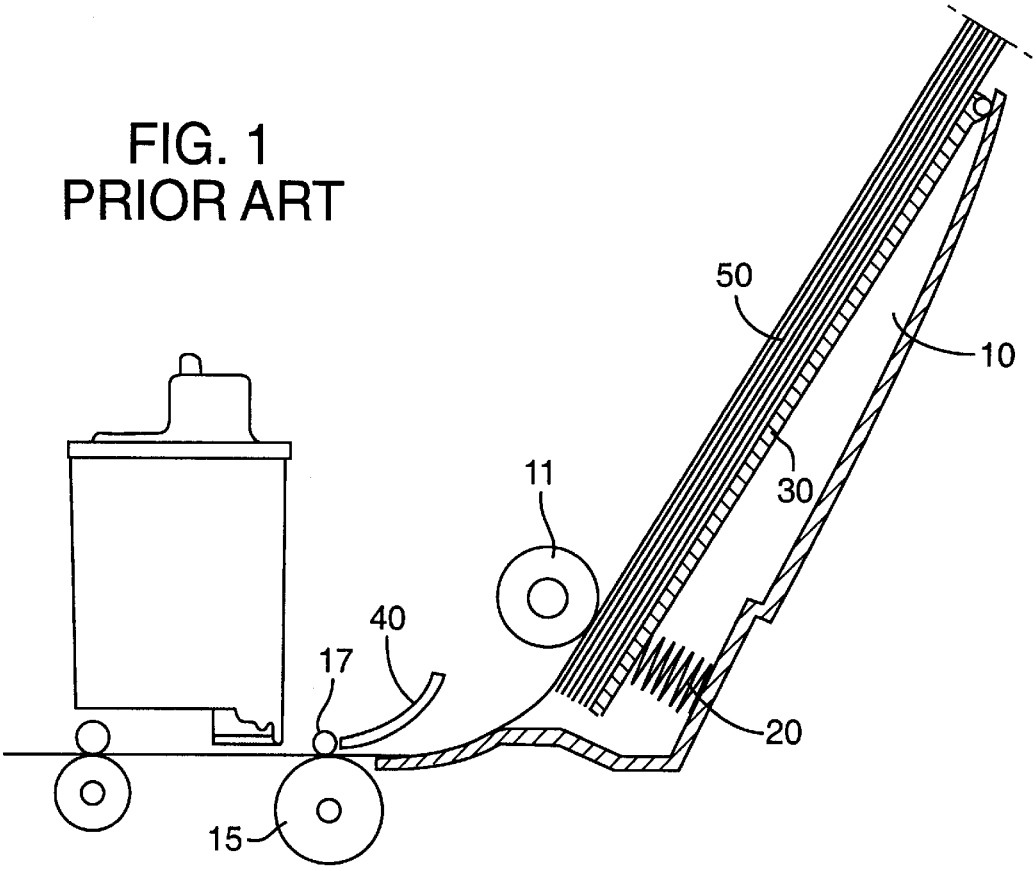
FIG. 1 PRIOR ART
FIG. 1 is a schematic elevational view illustrating a conventional printing apparatus.
Figure 2:
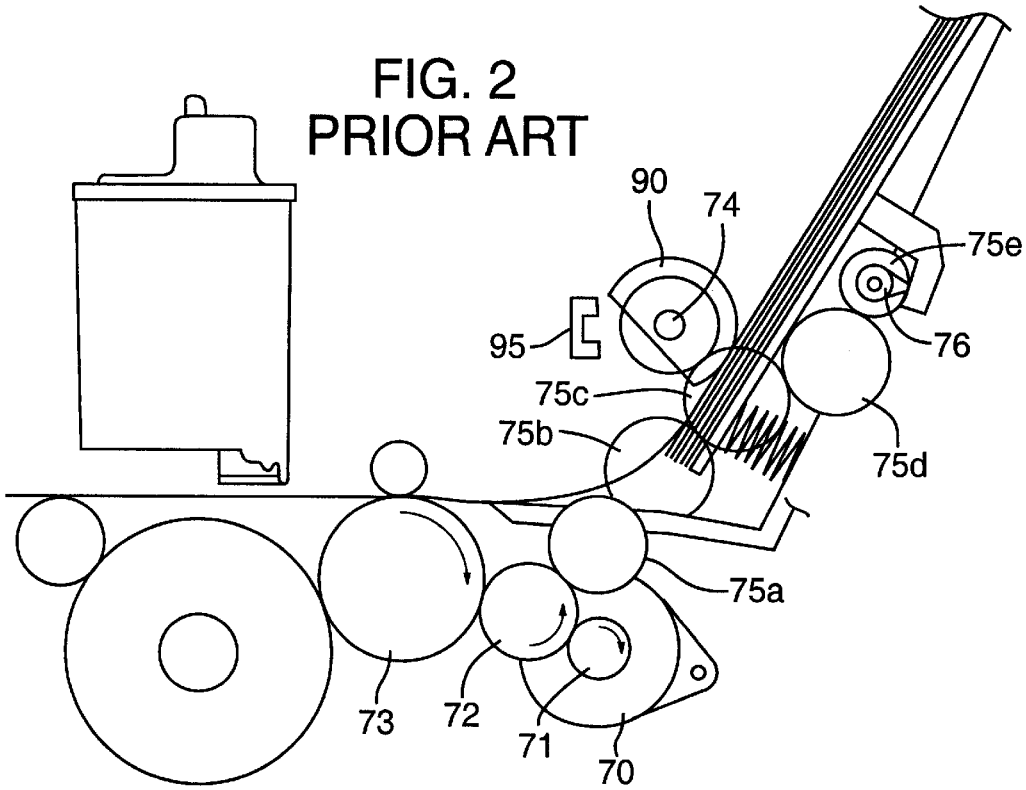
FIG. 2 PRIOR ART
FIG. 2 illustrates a schematic elevational view of a contemporary auto sheet feeding device.
Figure 3:
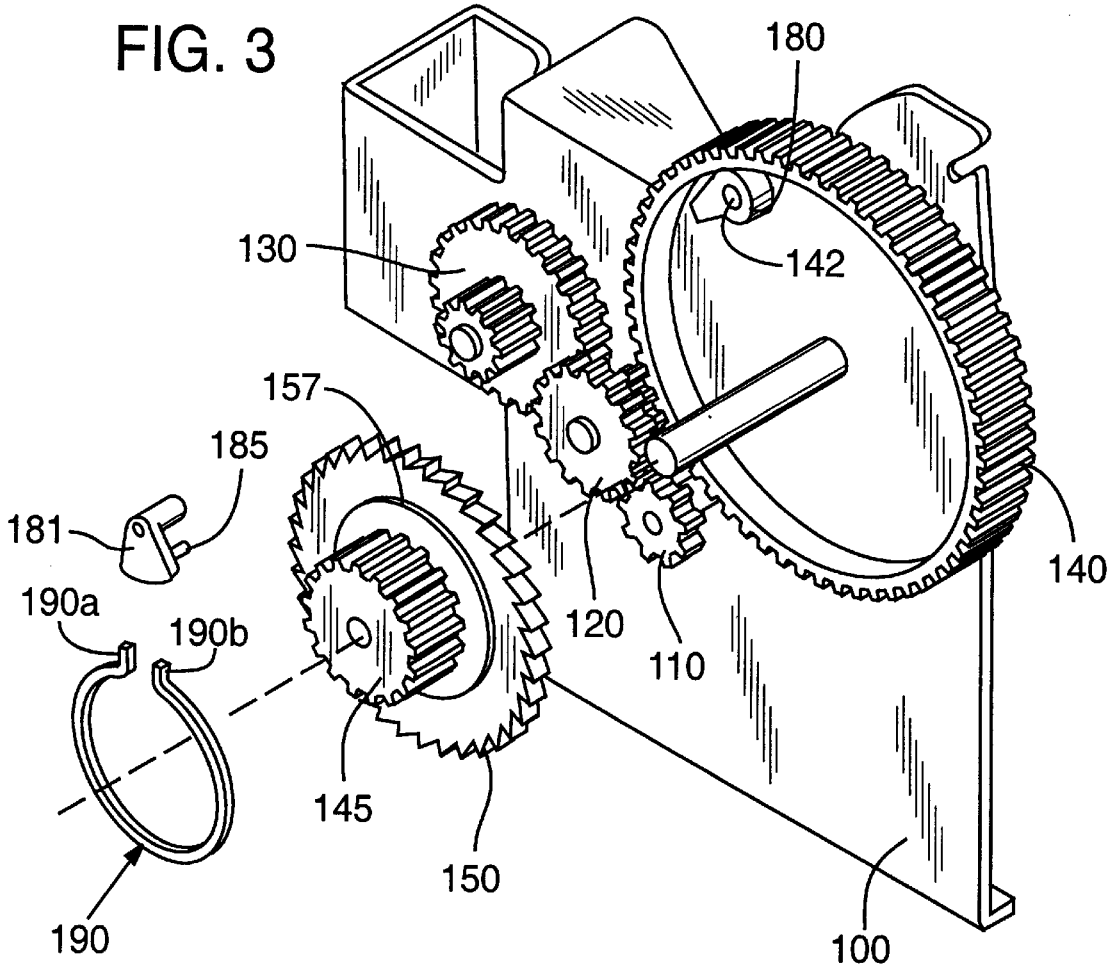
FIG. 3 is an exploded perspective view of a preferred embodiment of an exemplar driving portion of auto sheet feeding device built according to the principles of the present invention.
Figure 4:
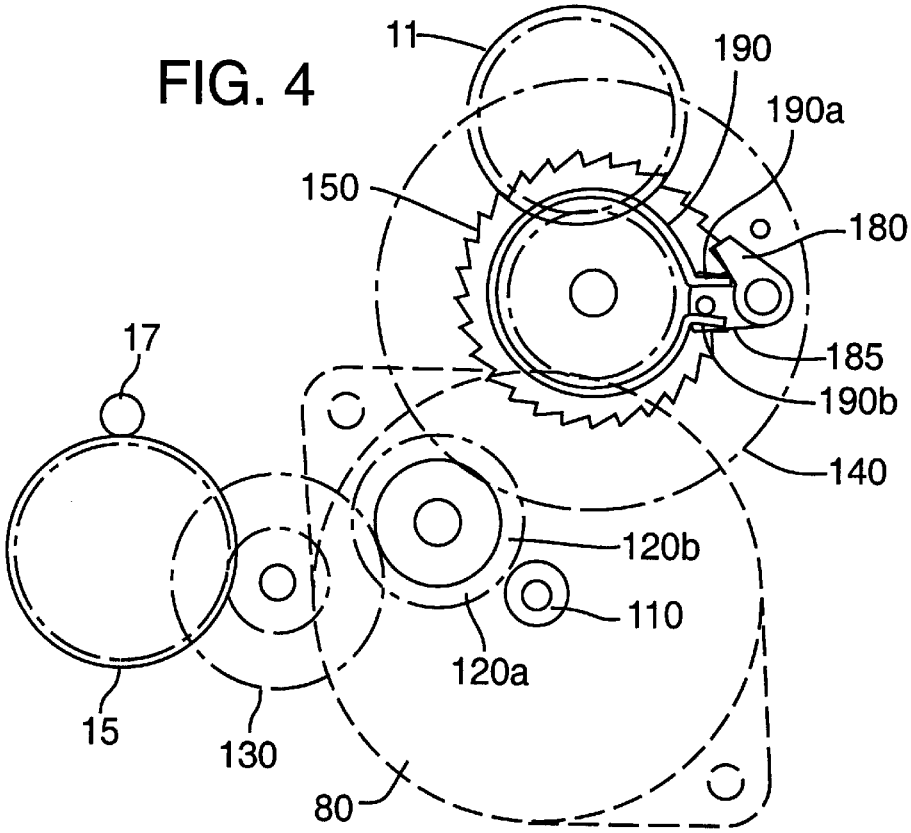
FIG. 4 illustrates an operational status of the device in FIG. 3 in which cam suspends the rotational motion of latch gear.
Figure 5:
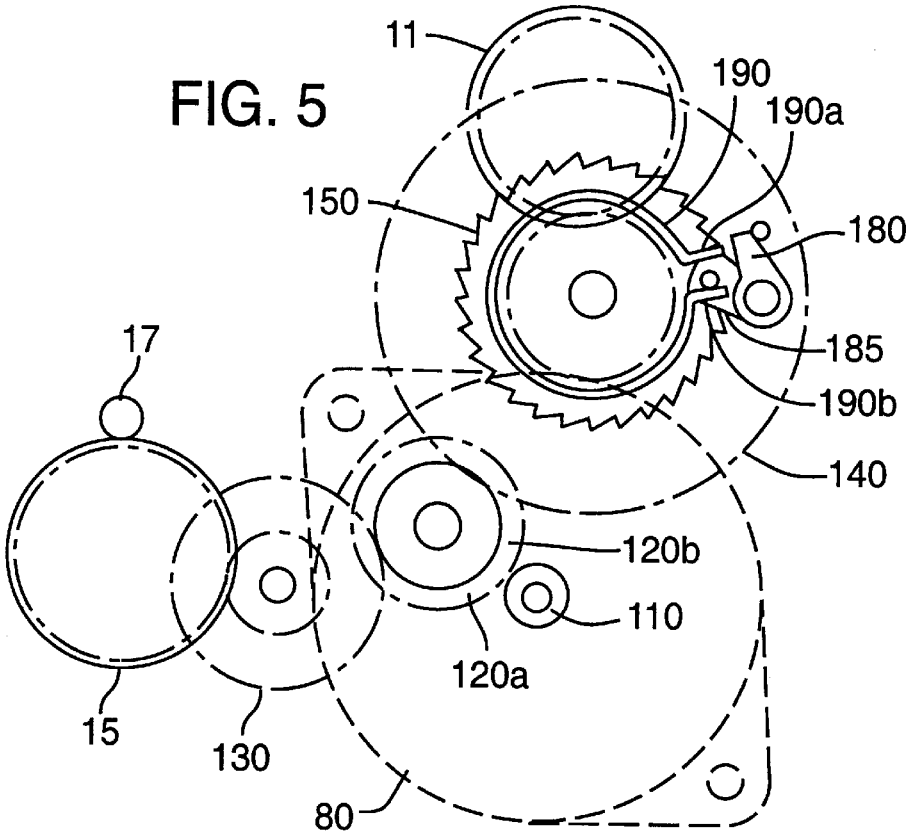
FIG. 5 illustrates another operational status of the device in FIG. 3 in which cam is released.

Turning now to the drawings and referring to FIG. 3, motor 80 is installed at the backward portion of bracket 100 so as to drive a printing apparatus. A gear 110 coaxial linked to the pivot of motor 80 is engaged with an outside gear 120*a* of double-geared idle gear 120. An inner gear 120*b* of the above idle gear 120 is engaged with idle gear 140 and driving gear 130 for driving to both direction from motor 80 is able to be performed. A feeding roller driving gear 145 is coaxial mounted an to the axis of idle gear 140.

The above described idle gear 140 and feeding roller driving gear 145 are installed on same axis so as to rotate unrestrictedly in any directions.

Double-geared feeding roller driving gear 145 as described above is integrally formed with latch gear 150 and is arranged to engage with feeding roller gear. Latch gear 150 is selectively contacted by latch 180 installed on idle gear 140.

A substantially circular groove 157 formed between latch gear 150 and feeding roller driving gear 145 receives a ring 190 having a pair of edge portions 190*a* and 190*b* that are arranged to selectively contact with boss 185 formed on wing tab 1B1.

In operation, motor 80 initiates to rotate so as to feed a sheet. As motor 80 rotates in normal direction, idle gear 120 is forced to rotate in clockwise direction thereby turning delivery roller driving gear 130 in counter-clockwise direction. As result, delivery roller 15 in mesh with delivery roller driving gear 130 rotates in clockwise direction thereby blocking sheet feeding.

An idle gear 140 in mesh with idle gear 120 is forced to rotate in counter-clockwise direction, driving feeding roller driving gear 145 coaxial mounted to the axis of idle gear 140 and, in turn, feeding roller 11, thereby feeding a sheet mounted in a paper tray 10. Now, a detailed explanation will be given to the operation of feeding roller 11.

As idle gear 140 rotates, boss 185 formed on wing tab 181 which is connected to pivot 142 gets struck by an edge portion 190*a* of ring 190, causing latch 180 to turn about pivot 142 to thereby interlock with latch gear 150. As a result, latch gear 150 engages with idle gear 140. As feeding roller driving gear 145 integrally, formed with latch gear 150 rotates in counter-clockwise direction, feeding roller 11 in mesh therewith is forced to turn in clockwise direction.

The rotational motion of feeding roller 11 pushes aside a sheet stuck to the lower surface thereof by friction force. Once the front edge of a sheet gets sufficiently closer to the contact point between delivery roller 15 and friction roller 17, then motor 80 is forced to rotate in reverse direction.

Rotational directions of a variety of gears in mesh with train of gearing are forced to shift due to reverse revolution of motor 80. When the rotational friction of idle gear 120 is shifted to counter-clockwise direction, boss 185 formed on wing tab 181 is forced to run against another edge 190*b* of ring 190. Thus latch 180 is urged to turn in clockwise direction, thereby releasing latch gear 150 becomes free and feeding roller 11 ceases operation. In addition, delivery roller driving gear 130 engaged with idle gear 120 rotates in clockwise direction, driving delivery roller 15 to turn in counter-clockwise direction, thereby allowing a sheet to be delivered by mutual friction force between delivery roller 15 and friction roller 17.

Upon application of the present invention, the quantity of gears in train of gearing required for sheet feeding operation in a printing apparatus is able to be substantially reduced in a simplified construction, at a low cost.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An auto sheet feeding device for use in a printing apparatus, said device comprising:

a motor for generating and transmitting power;

a first idle gear in mesh with a gear mounted on a rotational pivot of said motor;

a delivery roller driving portion for receiving power transmission from said first idle gear to drive a delivery roller; and a feeding roller driving portion for intermittently driving a feeding roller with transmitted power from said first gear, said feeding roller driving portion includes a second idle gear in mesh with said first idle gear, a latch gear rotatable supported on a common axis with said second idle gear, and a latch for intermittently coupling said latch gear to said second idle gear so as to supply power to said feeding roller only when said latch gear is coupled to said second idle gear.

2. The auto sheet feeding device of claim 1 wherein said feeding roller driving portion further includes a ring inserted in a groove formed on said latch gear, said ring having a pair of edge portions, and said latch being located with respect to said edge portions so that said latch selectively contacts one or the other of said edge portion to selectively couple and uncouple said latch gear to said second idle gear.

3. The auto sheet feeding device of claim 2 wherein said feeding roller driving portion includes a feeding roller driving gear integrally formed with said latch gear, said feeding roller driving gear drivingly engaging said feeding roller.

4. The auto sheet feeding device of claim 3 wherein said second idle gear has an annular rim with gear teeth on the outside of said annular rim, said annular rim defining cylindrical inner volume for receiving said latch and latch gear.

5. An auto sheet feeding device for use in a printing apparatus, said device comprising:

a motor for generating and transmitting power;

a first idle gear in mesh with a gear drivingly coupled to said motor;

a feeding roller for feeding sheets from a stack of sheets;

a delivery roller for moving sheets from said feeding roller;

a driving gear meshing with said first idle gear and coupled to said delivery roller for rotating said driving roller in two directions;

a second idle gear meshing with said first idle gear and being rotated by said first idle gear in two directions, said second idle gear including an annular rim with gear teeth on an outer surface of said annular rim, said gear teeth meshing with gear teeth of said first idle gear, said annular rim defining an inner cylindrical volume;

a rod extending from the center of said inner cylindrical volume, a latch gear mounted on said rod and received in said inner cylindrical volume, a latch pivotally mounted to said second idle gear adjacent said annular rim and pivotably movable between a first position in engagement with said latch gear and a second position out of engagement with said latch gear when the direction of rotation of said second idle gear changes;

a feeding roller driving gear coupled to said feeding roller to transmit rotary motion to said feeding roller and connected to said latch gear for rotary motion in unison with said latch gear to rotate said feeding roller; said latch gear being rotated in unison with said second idle gear only when said second idle gear rotates in a first direction and said latch is in said first position, and said latch gear being freely rotatable about said rod when said second idle gear rotates in a second direction and said latch is in said second position to thereby stop the rotation of said feeding roller.

6. The auto sheet feeding device of claim 5 wherein said latch gear and said feeding roller driving gear are formed integral with one another.

7. The auto sheet feeding device of claim 5 wherein a tab is pivotally mounted to said second idle gear adjacent to said latch and includes a boss extending from it, said boss being coupled to said latch and being engagable by projections extending from said latch gear to pivot said latch between said first and second position.

8. The auto sheet feed device of claim 7 wherein said projections extending from said latch gear are formed as edge portions of a ring carried in a groove on said latch gear.

* * * * *